United States Patent [19]

Sanmiya

[11] Patent Number: 5,044,192

[45] Date of Patent: Sep. 3, 1991

[54] LUG STRAIGHTENER

[75] Inventor: Tei S. Sanmiya, Walden, Canada

[73] Assignee: Inco Limited, Toronto, Canada

[21] Appl. No.: 537,068

[22] Filed: Jun. 12, 1990

[30] Foreign Application Priority Data

Jun. 19, 1989 [CA] Canada ..... 603214

[51] Int. Cl.[5] ..... B21D 1/10

[52] U.S. Cl. ..... 72/458; 72/479; 81/124.2; 81/177.5

[58] Field of Search ..... 72/458, 479, 457, 459; 81/124.2, 176.15, 177.5

[56] References Cited

U.S. PATENT DOCUMENTS

| | | | |
|---|---|---|---|
| 174,486 | 3/1876 | Collingsworth | 81/124.2 |
| D. 261,606 | 11/1981 | LaFargo | 81/124.2 |
| 2,116,770 | 5/1938 | Scillia | 81/124.2 |
| 2,231,323 | 2/1941 | Cawood | 81/124.2 |
| 2,283,789 | 5/1942 | Buckwalter | 72/458 |
| 2,824,474 | 2/1958 | Lawrence | 72/458 |
| 2,968,980 | 1/1961 | Zierold | 81/177.5 |
| 3,190,250 | 6/1965 | Hinden | 72/457 |
| 3,578,046 | 5/1971 | Curran | 81/176.15 |
| 4,125,913 | 11/1978 | Lewis | 81/124.2 |
| 4,836,065 | 6/1989 | Setliff | 81/124.2 |

FOREIGN PATENT DOCUMENTS

| | | | |
|---|---|---|---|
| 473116 | 12/1914 | France | 81/124.2 |
| 269871 | 11/1950 | Switzerland | 72/458 |

*Primary Examiner*—David Jones

*Attorney, Agent, or Firm*—Francis J. Mulligan, Jr.; Blake T. Biederman

[57] ABSTRACT

A process for straightening a crossbar of an anode to correct the suspension of the anode while the anode remain in an electrolytic cell. The process has an elongated shaft having a lower portion and an upper portion. A transverse slot extends longitudinally upward into the lower portion of the shaft. The slot has sufficient width to receive an upper portion of the crossbar. A handle is attached to the upper portion of the shaft. The handle extends laterally outward from the shaft. The handle is for twisting the shaft to cause the slot to straighten twisted crossbars within the slot.

3 Claims, 1 Drawing Sheet

LUG STRAIGHTENER

The present invention relates to a tool for adjusting the suspension of an anode in an electrowinning cell. More particularly, it relates to a tool for straightening bent and twisted anode lugs.

BACKGROUND OF THE ART AND PROBLEM

Typical electrowinning operations are constructed having several electrolytic cells. Each electrolytic cell contains several anodes and cathodes suspended in an aqueous electrolyte solution. During electrowinning, a metal from the electrolyte, such as copper, nickel or cobalt, is deposited on the cathode as a metal. After electrowinning for a period of time, the cathodes are removed by an overhead crane from the electrolytic cell to remove the electrodeposited metal. Overhead cranes as in a typical setup transport several cathodes or blanks at the same time. The metal is then separated from the blanks and the clean blanks are returned to the cell with the overhead crane. If a strip or sheet-type cathode is being used, the strip sheet and deposited metal are removed by an overhead crane and additional strip sheets are placed into the electrolytic cell. During these operations, the crane operator will occasionally misjudge the location of the cathodes and crash into the anodes. This overhead crane contact bends and twists anode lugs or crossbars. The bending and twisting of anode crossbars has a tendency to cause the suspension of the anodes to be tilted from vertical.

Anode crossbars are also commonly bent and twisted when nodules of metal grow from the cathodes and attach to heavy adjacent anodes, such as lead anodes. When the operator lifts the cathodes from the cell, the anodes attached by the nodules are also lifted. When this occurs, the operator stops lifting and holds the cathodes and anodes above the cell to separate the anodes from the cathodes. The anodes are pounded or pried from the cathode and the heavy anodes are permitted to fall back into cell. The anode crossbars strike against the cell wall, bending and twisting the crossbars, causing the suspension of the anodes to become unaligned or off vertical in the cell.

When the anode suspends at a great enough angle from vertical alignment, the anode contacts an adjacent cathode short-circuiting the electrowinning process. Conventional tools such as pliers and wrenches are extremely difficult to use for straightening lugs while the anode is suspended in the electrolyte. To straighten the anode crossbar, the anode is removed from the cell, where the crossbar is then straightened. The heavy anode must then be returned to the cell where the alignment is checked. If the anode continues to tilt in the cell, the anode must be removed and further adjusted. This process is repeated until the anode has satisfactory alignment in the cell. Removing the heavy anodes from the cells to repair the anodes is burdensome; additionally, the electrowinning process is interrupted on the two cathode sides adjacent the anode while the cathode is removed from the cell.

SUMMARY OF THE INVENTION

The invention provides a tool for straightening a lug of an anode to correct the suspension of the anode while the anode remians in an electrolytic cell. The tool includes an elongated shaft having a lower portion and an upper portion. A transverse slot extends longitudinally upward into the lower portion of the shaft. The slot has sufficient width for receiving an upper portion of the lug. A handle attached to the upper portion of the shaft extends laterally outward from the shaft. The handle is for turning the shaft to cause the slot to straighten twisted crossbars within the slot.

Preferably, the handle extends orthogonally from a center axis of the shaft in opposing directions. The shaft is preferably approximately 1 m in length and the handle preferably has a length greater than the length of the shaft. Ideally, the slot bisects the lower portion of the shaft. The tool is preferably used for straightening copper crossbars cast into lead or lead alloy anodes.

EMBODIMENTS OF THE INVENTION

Figure 1:
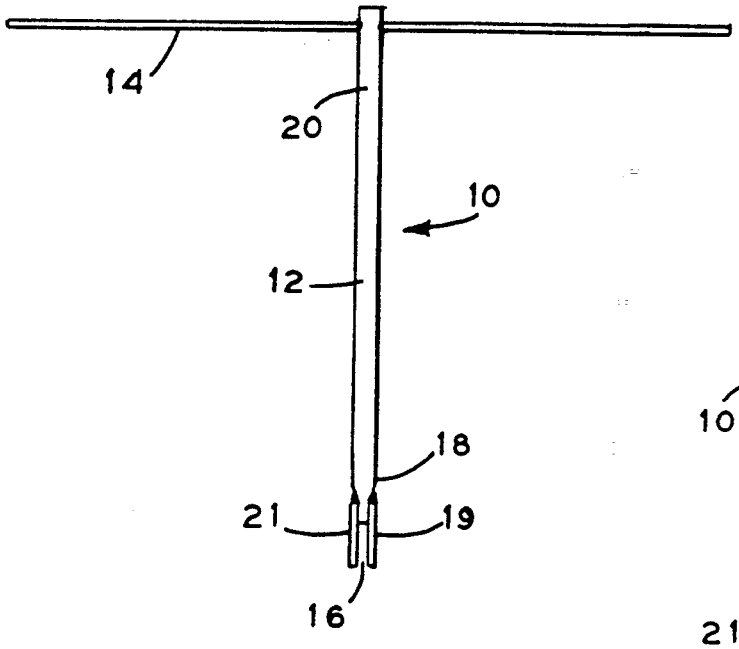
FIG. 1 is a schematic frontal view of a lug straightener.
Figure 2:
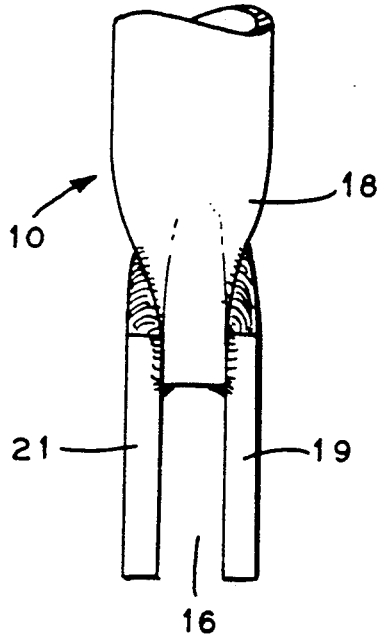
FIG. 2 is an enlarged schematic view of the lower portion of the shaft of FIG. 1 illustrating the slot.

Referring to FIGS. 1 and 2, the anode lug straightener 10 is constructed with three major components, a shaft 12, a handle 14, and a slot 16. The shaft 12 is elongated, having a lower portion 18 and an upper portion 20. The handle 14 is attached to the upper portion 20 of the shaft 12. Rotation of the handle 14 turns the shaft 12, slot 16 and lugs within the slot 16 to straighten twisted lugs.

The slot 16 extends transversely across the shaft 12 and extends longitudinally upward into the lower portion 18 of the shaft 12. The slot 16 has a width sufficient to receive the width of an anode lug or crossbar. The handle 14 is preferably constructed by drilling a hole through the upper portion of the shaft 12. The handle 14 is then inserted halfway through the shaft 12 and welded in position. The handle 14 may be attached by alternate means such as a threaded connection, screws, nut and bolt or any other known means of connecting a handle to a shaft 12. Additionally, the handle 14 may be removably attached to the shaft 12.

The shaft 12 and handle 14 are preferably constructed of hollow piping to reduce the weight of the lug straightener 10. A lug straightener constructed with a solid steel handle and shaft would operate, but the tool would be cumbersome and too heavy to be easily carried from anode to anode. Slot 16 is formed by first flattening the end of the lower portion 18. Opposing bars 19 and 21 are then welded to the flattened portion of the shaft 12. Shafts and slots may alternatively be constructed of two elongated bars attached together and spaced at the lower portion to form a transverse slot, with a square cross-section bar having the transverse slot extending longitudinally upward into two opposing sides of the square bar or any other known method of producing a slot in a shaft.

Figure 3:
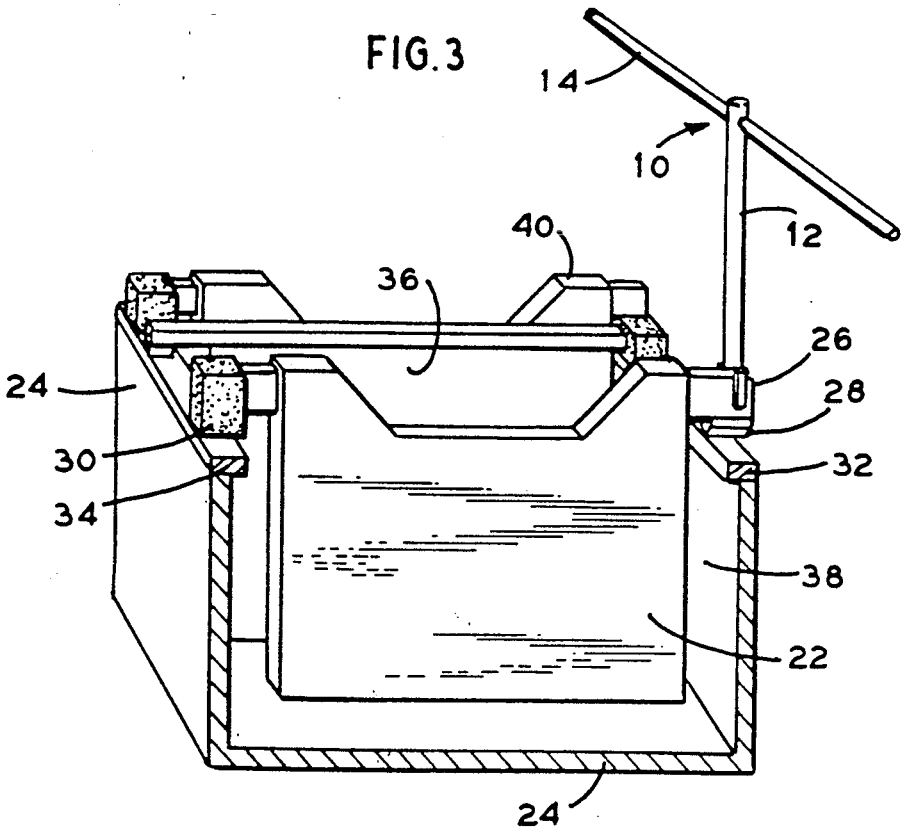
FIG. 3 is a schematic perspective view of an anode suspended in an electrolytic cell with portions of the electrolytic cell broken away and of the lug straightener of FIG. 1 having the lug of the anode within the slot of the lug straightener.

The slot 16 is preferably cut transversely across the shaft 12 to bisect the lower end of the shaft 12 into two equally divided sections. Preferably, the handle 14 extends in opposing directions orthogonal to a transverse direction of the slot 16. The transverse direction of the slot 16 is the direction the slot 16 cuts across the shaft 12. Referring to FIG. 3, this feature facilitates the adjustment of the crossbar 26 of anode 22 in the electrolytic cell 24. The alignment of the crossbar 26 and the anode 22 is performed by visual inspection. The orthogonal orientation of the handle 14 allows the operator to stand perpendicular to the longitudinal direction of the crossbar 26 for observing the alignment of the crossbar 26 and the anode 22 while grasping the handle 14. When the crossbar 26 is straightened the handle 14 is in a horizontal orientation perpendicular to the longitudinal direction of the crossbar 26. If the slot 16 had a different orientation, the lug straightener 10 would still operate, but the operator would have to move to get a proper line of sight for verifying the alignment of the anode 22 and crossbar 26 after bending and twisting the crossbar 26.

To operate the invention, the handle 14 or shaft 12 is first used to carry the invention to the anode requiring service. Operators may typically walk freely on the crossbars of anodes and blanks above the cell to the desired anode. An operator simply picks the lug straightener 10 up by the handle 14 or shaft 12 and carries the tool to the unaligned anode 22 in the electrolytic cell 24. The operator lowers the slot (not illustrated in FIG. 3) onto the lug or crossbar 26. The operator then either pushes the shaft 12 left or right depending upon which direction of movement is required to straighten the crossbar 26. The shaft may be pushed left or right with the handle 14. For example, a force applied against the shaft 12 may tilt or pivot the anode 22 about the knife-edge contacts 28 and 30 of the crossbar 26, partially lifting the anode 22 in the tank toward cathode 36. Knife-edge contacts 28 and insulating cap 30 pivot on the busbars 32 and 34 which supply electrical energy to the anodes and cathodes of the electrolytic cell 24. The electrolyte 38 adjacent the anode 22 pushes against the adjacent cathode 36 to tilt the cathode 36. The cathode 36 in turn pushes against the adjacent electrolyte 38 which pushes against the next anode 40. Quick movement of the lug straightener 10 prevents enough electrolyte 38 from flowing around the anode to substantially reduce the fluid resistance to movement of the anode 22. When the force of tilting the anode 22 and the fluid resistance to movement equals the yield strength of crossbar 26, the crossbar 26 bends. For purposes of this specification, bending a crossbar is defined as deforming the crossbar in a clockwise or counter-clockwise direction around an axis which extends longitudinally through the crossbar. This bending process is performed until the shaft 12 extends vertically upward. When the shaft 12 extends vertically upward, the crossbar 26 is straightened to a position in which the suspension of the anode 22 in the cell 24 is substantially aligned or vertical.

To correct twists in the crossbars 26, the handle 14 of the invention is utilized. Twisting of the crossbar, for purposes of this specification, is defined as deforming of a crossbar in the horizontal plane of an axis which extends longitudinally through the crossbar. The slot (not illustrated in FIG. 3) is first placed over the crossbar 26, the handle 14 is then turned to straighten the crossbar within the slot. The handle 14 is turned either clockwise or counter-clockwise, depending upon the direction the crossbar 26 is twisted. Having the handle 14 longer than that shaft 12 provides leverage to facilitate twisting the slot to straighten lugs or crossbars 26 within the slot. The weight of the anode 22 in the cell is sufficient to prevent the anode 22 itself from turning.

As constructed, the invention had an elongated shaft of approximately 1 m (3 ft) and a handle of approximately 1.2 m (4 ft.). The height of the straightener allows the operator to straighten anodes while standing on either crossbars of anodes or crossbars of cathodes suspended in an electrolytic cell. The shaft was constructed out of stainless steel pipe having an outer diameter of approximately 6.0 cm, an inner diameter of 4.9 cm and a thickness of 0.6 cm (2" schedule 80 pipe). The handle was similarly constructed out of stainless steel pipe having an outer diameter of approximately 3.3 cm, an inner diameter of approximately 2.4 cm and a thickness of 0.45 cm (1" schedule 80 pipe). A hole was drilled through the shaft; the handle was then inserted through the hole, centered and welded in position. The slot has a width of 1.35 cm and a depth of 6.35 cm adapted to receive a copper crossbar having a 1.3 cm by 6.4 cm transverse cross-section. The anode crossbars were integrally cast into lead 6% antimony anodes. The lead surrounds the middle portion of the crossbar to prevent the crossbar from dissolving in aqueous sulfuric acid electrolyte. This surrounding layer of lead strengthens the crossbar, forcing the uncovered end portions of the crossbars to bend and twist prior to the central covered portions of the crossbar.

The anodes had a length of 109 cm (91 cm in electrolyte) and a width of 86 cm. The anodes were tapered, having a top thickness of 2.5 cm and a bottom thickness of 0.8 cm. The typical weight of the anode was about 109 kg. A tankhouse having 49 electrolytic cells was used to electrowin copper. Each cell contained 67 anodes and 66 cathodes suspended in an aqueous sulfuric acid solution from crossbars having knife-edge contacts. The electrowinning cells had a length of 750 cm. a width of 114 cm and a depth ranging between 124 cm on the side and 127 cm in the center. Cathodes were constructed of a titanium mandrel or blank having a length of 114.6 cm (102 cm in electrolyte), width of 100 cm and a thickness of 0.3 cm. The blank weighed 17 kg and were suspended from copper crossbars of cross-rods.

The invention does not operate effectively to straighten relatively lightweight blanks. The lightweight blanks would pivot and lift easier in the electrolyte. Additionally, the blanks have a tendency to deform by having the middle of the crossbar deflecting downwardly. The lug straightener of the present invention is not designed to straighten blanks deformed downwardly in the middle of the crossbar, because the adjacent crossbars of anodes and blanks proximate the deformed blank would interfere with the operation of the handle and shaft. Blanks, unlike the anodes, must first be removed from the cell and then straightened.

However, the relatively heavy weight of the lead anodes combined with the high level of fluid resistance to anode movement permit the crossbar to effectively straighten anode crossbars with the lug straightener while the anode is suspended in the electrolytic cell. The device also, provides the unique feature of allowing a person to straighten twisted and bent crossbars while standing on anode or cathode crossbars. The lug straightener may be simply pushed or pulled for straightening bent crossbars to correct the alignment of anodes suspended in the electrolytic cell. The invention may also be utilized to straighten twisted crossbars within the slot. The handle is simply turned to straighten the twisted crossbars within the slot.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A tool for straightening a lug of an anode for correcting suspension of the anode while the anode remains in an electrolytic cell comprising:

an elongated shaft having a lower portion and an upper portion, the shaft having a length of at least about 1 m for waist level operating of the tool, the shaft being hollow for simplified hand-held transportation, the lower portion of the shaft having two opposing rectangular bars depending downwardly from the lower portion, and a transverse slot extending longitudinally upward between the rectangular bars, the rectangular bars having a transverse rectangular cross section, the slot having two parallel flat working surfaces, a width and a depth, the slot being adapted for receiving the lug by placing the working surfaces of the slot adjacent opposing sides of the lug, the width being adapted for twisting the lug and the depth being adapted for pivoting the lug, and a handle attached to the upper portion of the shaft, the handle being hollow for simplified hand-held transportation, the handle extending laterally outward in substantially opposing directions orthoganal to a transverse direction of the slot from the shaft for turning the shaft to cause the slot to straighten twisted lugs within the slot and for visually determining alignment of a lug without moving and for tilting the shaft for pivoting the lug to correct tilted suspension of the anode.

2. The tool of claim 1 wherein the handle has a length greater than the length of the shaft for effective twisting of the lug.

3. The tool of claim 1 wherein the slot has a top portion which is rectangularly shaped for receiving a rectangular top portion of the lug.

* * * * *